US007980878B2

(12) United States Patent
Lee et al.

(10) Patent No.: US 7,980,878 B2
(45) Date of Patent: Jul. 19, 2011

(54) ELECTRICAL CONNECTOR ASSEMBLY WITH CLAMPING MEMBERS

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 12/687,441

(22) Filed: Jan. 14, 2010

(65) Prior Publication Data

US 2011/0143597 A1 Jun. 16, 2011

(30) Foreign Application Priority Data

Dec. 11, 2009 (TW) ..... 98223290 U

(51) Int. Cl.
*H01R 13/62* (2006.01)

(52) U.S. Cl. ..... 439/326

(58) Field of Classification Search ..... 439/326–328, 439/377
See application file for complete search history.

(56) References Cited

U.S. PATENT DOCUMENTS 6,174,187 B1 * 1/2001 Yamagami et al. ..... 439/326
6,319,035 B1 * 11/2001 Choy ..... 439/326

* cited by examiner

*Primary Examiner* — Javaid Nasri
(74) *Attorney, Agent, or Firm* — Rosenberg, Klein & Lee

(57) ABSTRACT

A connector assembly for holding a memory card provided with two card holes, includes an insulated body, two fixing members projecting from two opposite ends of the insulated body, two supporting elements formed on a front side of the insulated body and two clamping members mounted respectively on the opposite ends of the insulated body. Once the memory card is inserted into the electrical connector assembly, the clamping members cooperatively clamp two opposite ends of the memory card therebetween with the supporting elements extend respectively through the card holes in the memory card.

12 Claims, 11 Drawing Sheets

ELECTRICAL CONNECTOR ASSEMBLY WITH CLAMPING MEMBERS

This application claims the benefits of the Taiwan Patent Application Serial NO. 098223290, filed on Dec. 11, 2009, the subject matter of which is incorporated herein by reference.

BACKGROUND OF THE INVENTION

1. Field of the Invention

The present invention relates to an electrical connector assembly, more particularly to an electrical connector assembly having a pair of clamping members of simple structure for clamping a memory module or device therebetween.

2. Description of the Prior Art

FIG. 1 shows a partly exploded view of a conventional edge connector. The edge connector 100 includes an insulated body 10, a pair of clamping members 20 mounted at two opposite ends thereof and a plurality of first and second terminals 30, 40. The insulated body 10 is formed with a reception chamber 11, into which, a memory card (not shown) is to be inserted. The clamping members 20 are provided with one pair of edge engaging elements 21 for engaging the edges of memory card and a pair of support seats 22 for supporting the memory card thereon, thereby preventing downward leaning of the clamping members 20 (hence the assembly) once the memory card is clamped between the clamping members 20.

One disadvantage of the aforesaid clamping members 20 resides in that its structure is relatively complicated and thus results in extra manufacturing expense. In addition, the printed circuit board has limited room due to presence of the support seats 22 thereon, thereby hindering a flexible use of the space on the printed circuit board.

Moreover, the first and second terminals 30, 40 are mounted on front and rear sides of the insulated body 10 such that in case inappropriate mounting of the terminals may result poor quality of the connector assembly, and the former must be discarded, thereby causing material waste.

SUMMARY OF THE INVENTION

Therefore, the object of the present invention is to provide an electrical connector assembly having a pair of clamping members of simple structure and terminal retention members, upon which terminals can be easily installed, thereby increasing the quality but reducing the manufacturing expense of the electrical connector assembly.

The electrical connector assembly according to the present invention is used for holding a memory card provided with two card holes, and includes an insulated base, two clamping members and first and second retention members. The insulated base includes an insulated body, two fixing members and two supporting elements.

The insulated body has a front side. The fixing members project from two opposite ends of the insulated body. The supporting elements are formed on the front side of the insulated body and project outward therefrom. The clamping members are mounted respectively on the opposite ends of the insulated body such that once the memory card is inserted into the electrical connector assembly, the clamping members cooperatively clamp two opposite ends of the memory card therebetween with the supporting elements extend respectively through the card holes in the memory card.

The first retention member includes a first retention body for coupling to a rear side of the insulated body and a plurality of first terminals mounted on the first retention body.

The second retention member includes a second retention body for coupling to the insulated body via a coupling slot formed in the bottom side of the insulated body and a plurality of second terminals mounted on the second retention body.

As described above, the electrical connector assembly of the present invention has the clamping members and supporting elements of simple structures, which cooperatively and stably retain the memory card without the prior art edge engaging elements for engaging the edges of memory card and support seats for supporting the memory card thereon. Thus, the manufacturing expense can be lowered and the space on the printed circuit board can be economized. Each of the supporting elements preferably has a planar support face and an engaging protrusion projecting perpendicularly from the support face such that once the memory card is inserted into the electrical connector assembly, the engaging protrusions respectively extend through and engage the card holes in the memory card, thereby preventing untimely removal of the memory card from the reception chamber in the insulated body of the electrical connector assembly of the present invention. In addition, the terminals can be partially inserted into the retention members via the insert molding process in advance and the retention members are later assembled on the insulated body. There is no requirement for inserting the first and second terminals one set after the other set as in the prior art. Hence, the quality of the electrical connector assembly is improved.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

Figure 2:
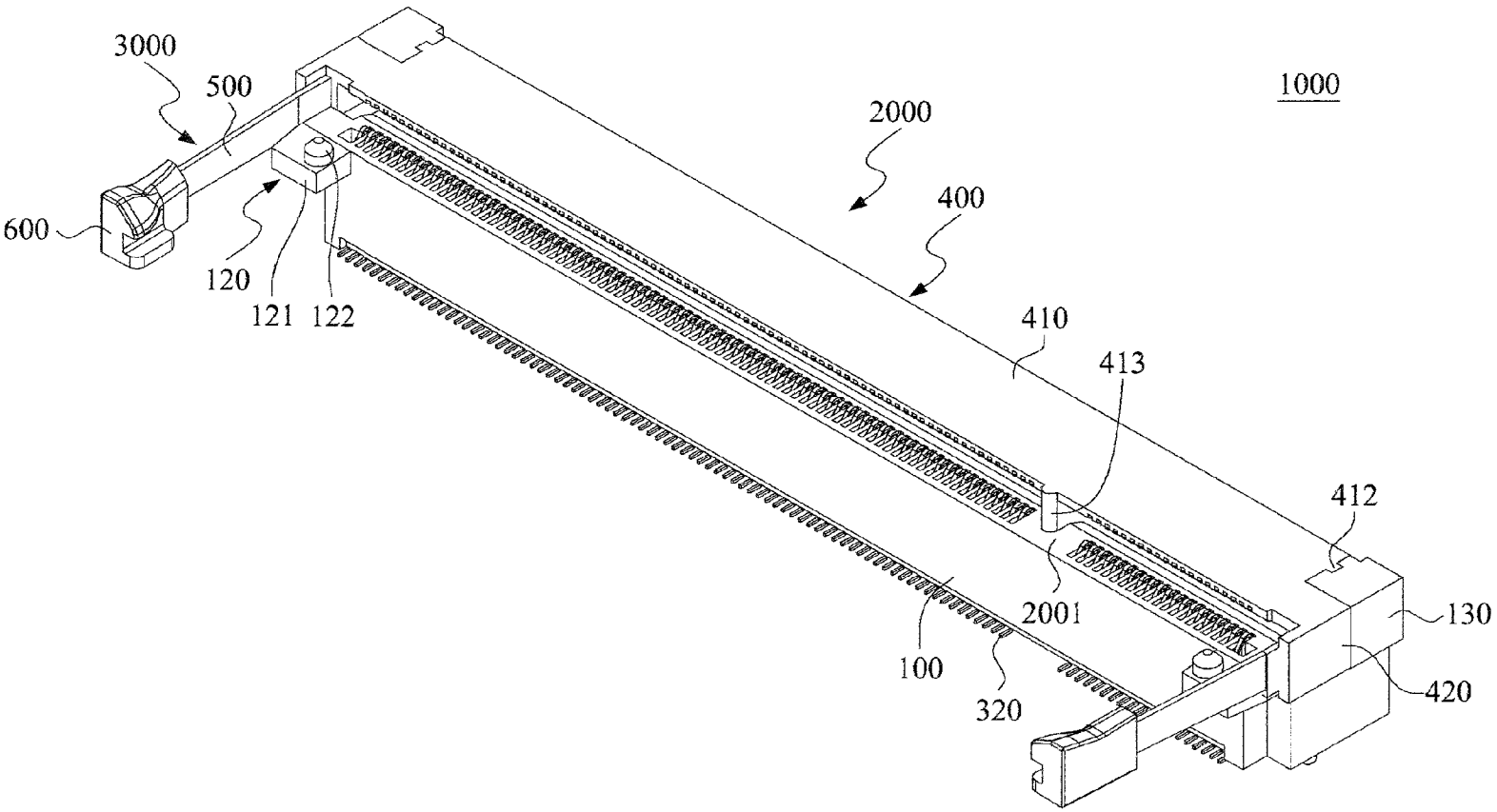
FIG. 2 shows a perspective view of an electrical connector assembly of the present invention.
Figure 3:
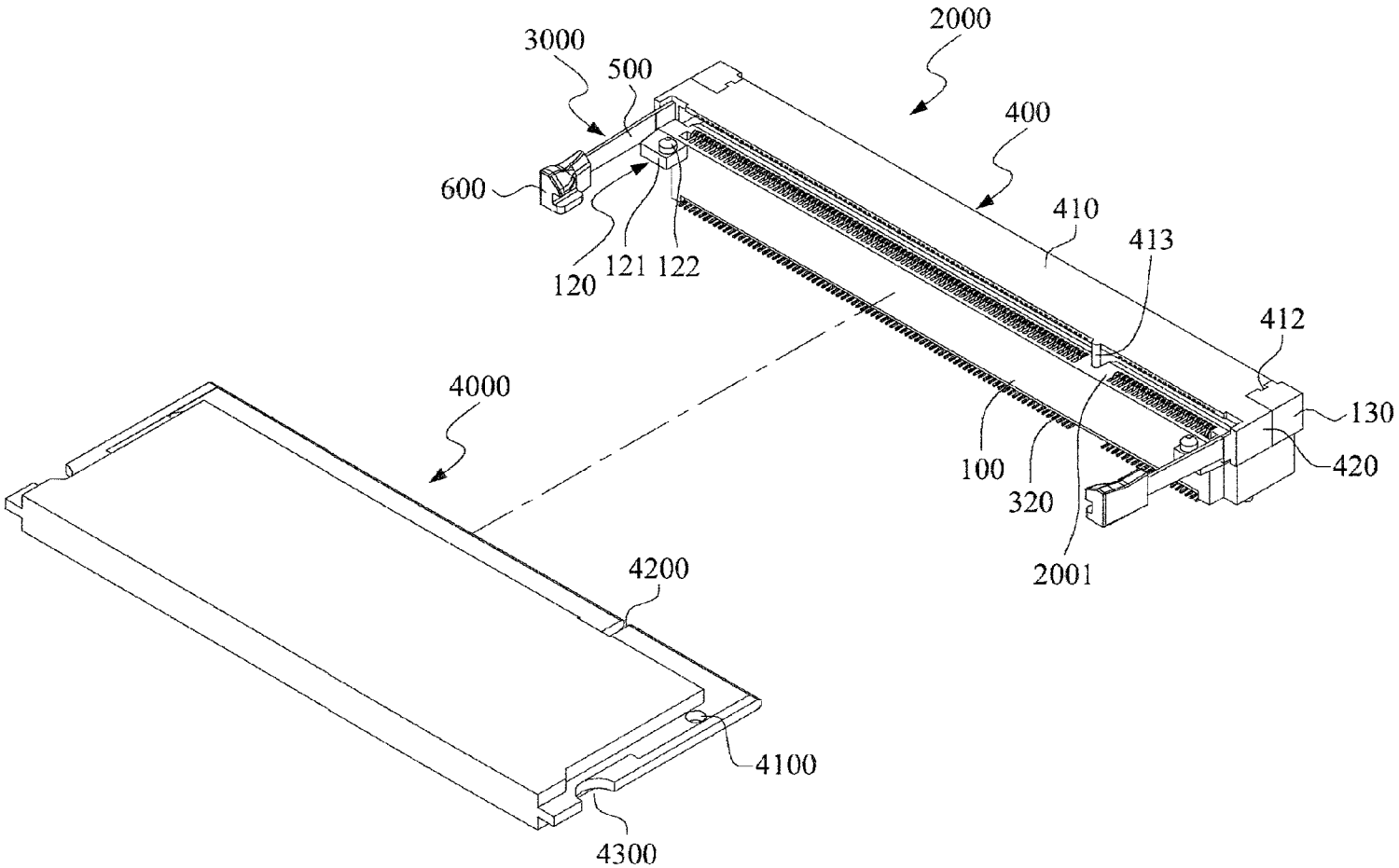
FIG. 3 shows the electrical connector assembly of the present invention in application.

Referring to FIGS. 2 and 3, wherein FIG. 2 shows a perspective view of an electrical connector assembly of the present invention while FIG. 3 shows the electrical connector assembly of the present invention in application. The electrical connector assembly 1000 of the present invention is used for holding a memory module 4000 provided with two card holes 4100 and two peripheral recesses 4300. The electrical connector assembly 1000 accordingly includes an (insulated) base member 2000 and two clamping members 3000 projecting outward from two opposite ends of the base member 2000.

Figure 1:
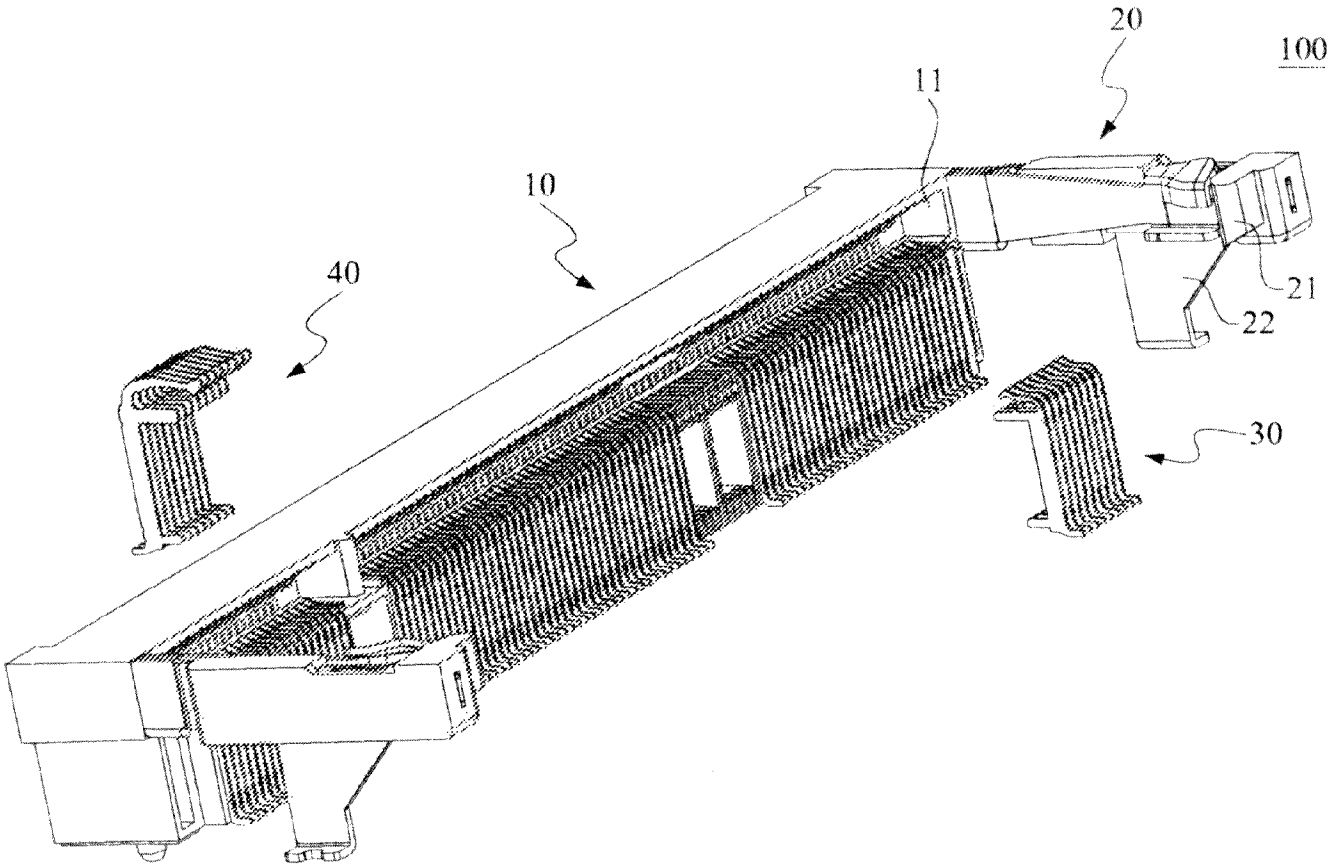
FIG.1 PRIOR ART
FIG. 1 shows a partly exploded view of a prior art edge connector.

The base member 2000 includes left and right supporting elements 120 formed on a front side 111 of the insulated body 110 and projecting outward therefrom such that once the memory module 4000 is inserted into the insulated body 100, the clamping members 3000 cooperatively clamp two opposite ends of the memory module 4000 therebetween with the supporting elements 120 extending respectively through the card holes 4100 in the memory module 4000, thereby retaining the memory module 4000 on the insulated body 100. Note that each of the clamping members 3000 is not provided with the edge engaging elements for engaging the edges of memory card and the support seat for supporting the memory card thereon as in the prior art (please see FIG. 1). Thus, the clamping members 3000 respectively have simple structure.

Figure 4:
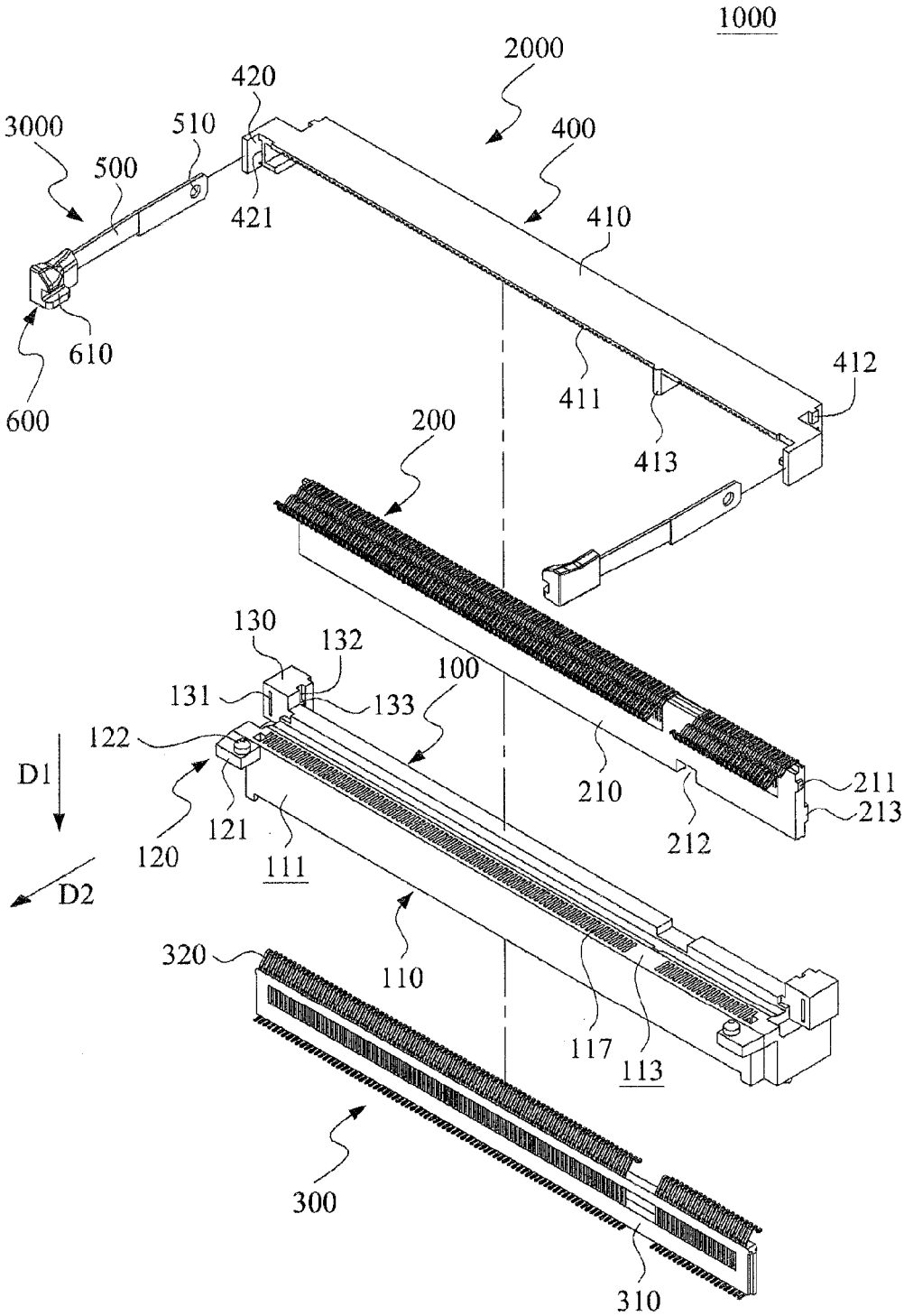
FIGS. 4 and 5 respectively show an exploded view of the electrical connector assembly of the present invention.
Figure 5:
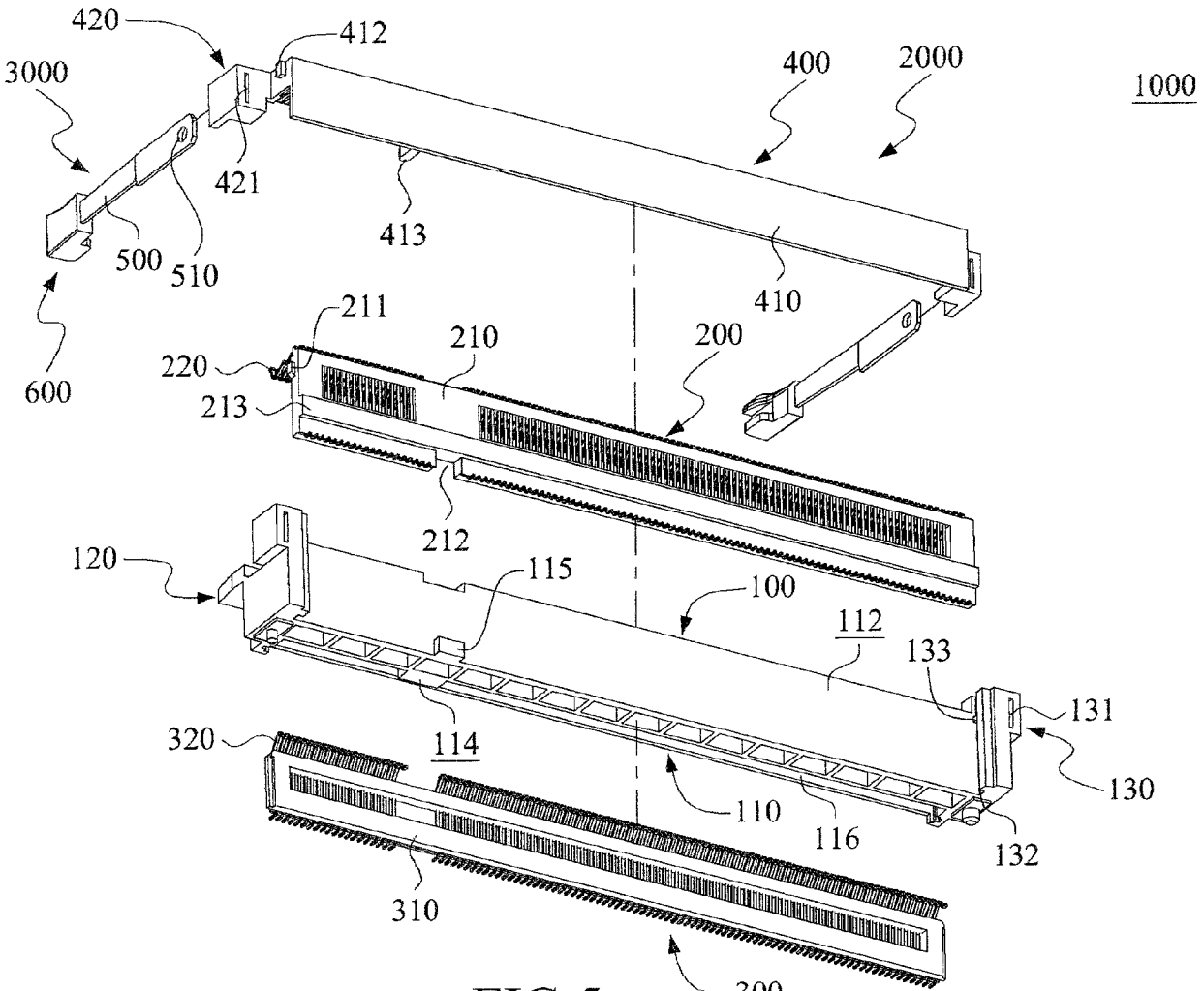
Figure 6:
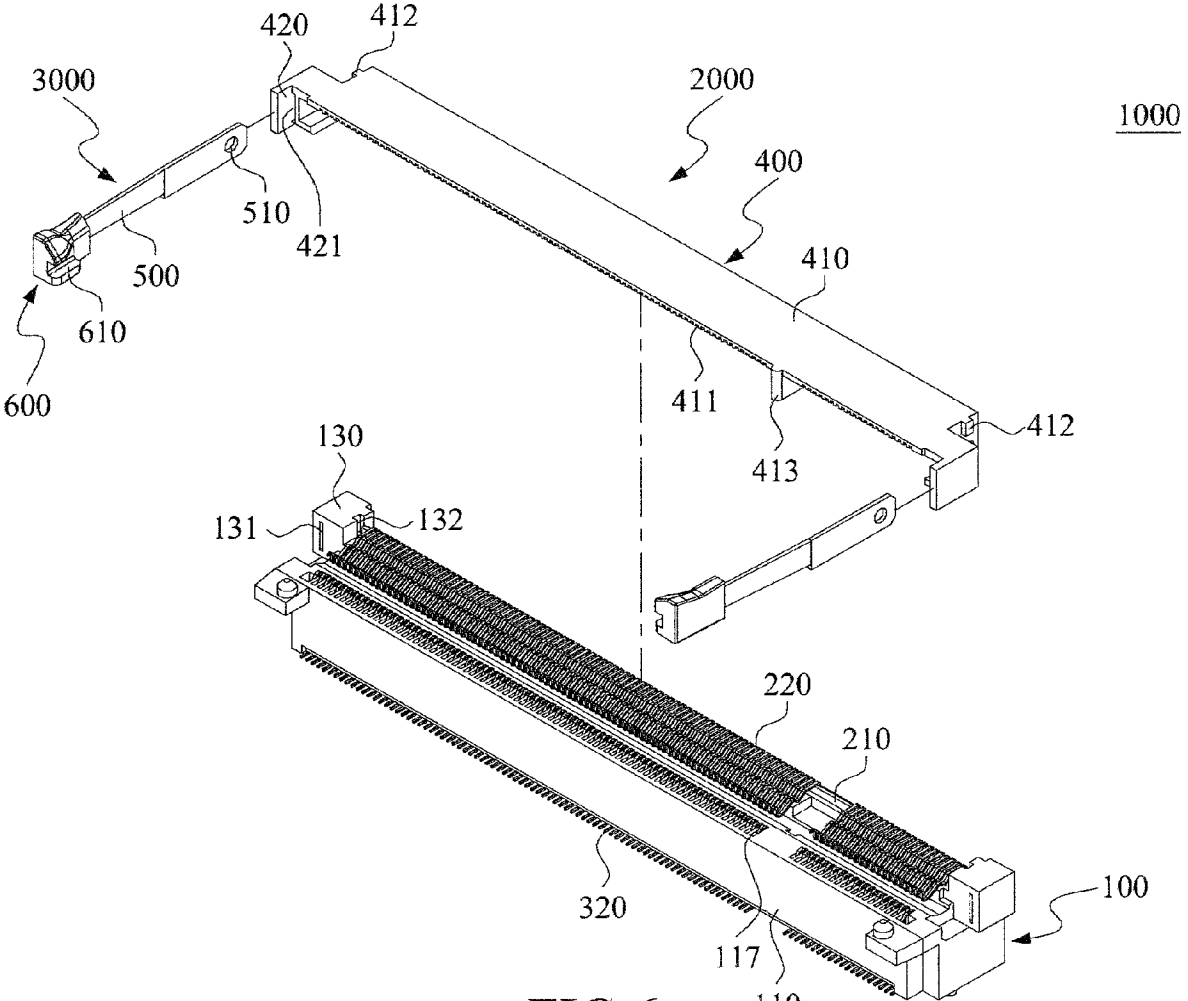
FIG. 6 is a partially exploded view of the electrical connector assembly of the present invention.
Figure 7:
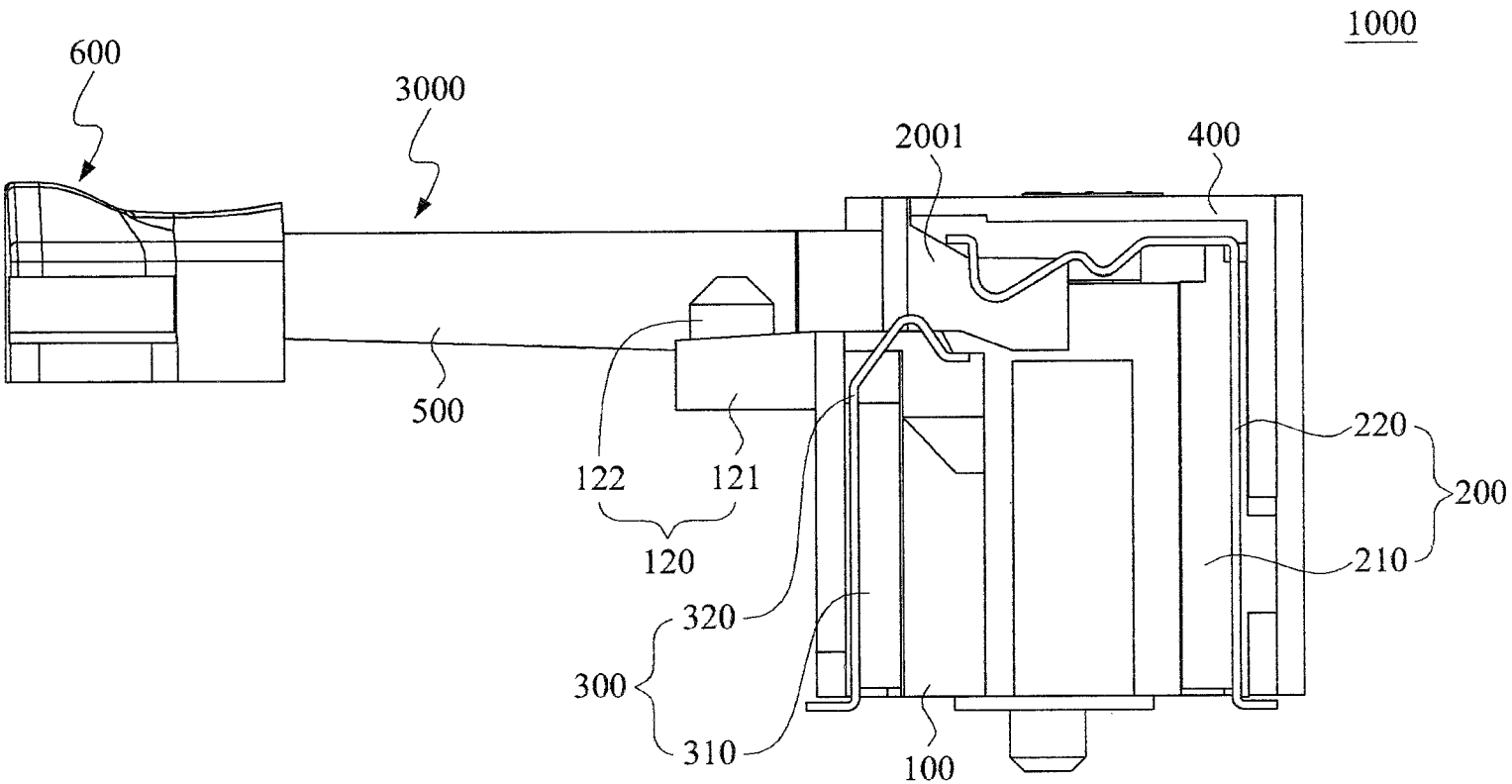
FIG. 7 is a fragmentary sectional view of the electrical connector assembly of the present invention.

Referring to FIGS. 4 to 7, wherein FIGS. 4 and 5 respectively show an exploded view of the electrical connector assembly of the present invention; FIG. 6 is a partially exploded view of the electrical connector assembly of the present invention while FIG. 7 is a fragmentary sectional view of the electrical connector assembly of the present invention;

The base member 2000 includes an insulated base 100, a first terminal retention member 200, a second terminal retention member 300 and enclosing body 400.

As illustrated, the insulated base 100 includes an insulated body 11, two supporting elements 120 and two fixing members 130. The insulated body 110 has a front side 111, a rear side 112 opposite to the front side 111, a top side 113 and a bottom side 114 opposite to the top side 113. The supporting elements 120 are formed on the front side 111 of the insulated body 110 and project outward therefrom. The two fixing members 130 project respectively from two opposite ends of the insulated body 110. The first retention member 200 is attached to the rear side 112 of the insulated body 110. The bottom side 114 of the insulated body 110 is formed with a coupling slot 116 extending along the direction D1 via which the second retention member 300 is inserted for coupling the same to the insulated body 110. The top side 113 of the insulated body 110 is formed with a plurality of terminal holes 117 respectively in spatial communication with the coupling slot 116.

Each of the supporting elements 120 has a planar support face 12 and an engaging protrusion 122 projecting perpendicularly from the support face 121 along the direction D2 such that once the memory module 4000 is inserted into the electrical connector assembly 1000 (see FIG. 8), the engaging protrusions 122 respectively extend through and engage the card holes 4100 in the memory module 4000. Under this condition, the bottom side of the memory module 4000 is seated securely and firmly on the planar support faces 12 of the supporting elements 120.

The fixing members 130 respectively project outward from the rear side 112 of the insulated body 110 cooperatively define a pair of clamp holes 131 extending along the direction D2 and a pair of guide slots 132 extending along the direction D1 for holding the first retention member 200, thereby mounting the first retention member 200 adjacent to the rear side 112 of the insulated body 110. The fixing members 130 further cooperatively define two first limiting blocks 133 within the pair of guide slots 132 respectively adjacent to the rear side 112 of the insulated body 110

The first retention member 200 preferably includes a first retention body 210 for coupling to the insulated body 210 and a plurality of first terminals 220 partially embedded in the first retention body 210 via the insert-molding process so as to extend along the direction D1. The insulated body 110 further has two second limiting blocks 211 at two opposite ends thereof for engaging the first limiting blocks 133 to prevent relative movement between the first retention body 210 and the insulated body 110 along the direction D1 once the first retention body 210 is mounted on the rear side 112 of the insulated body 110. In this embodiment, the rear side 112 of the insulated body 110 is further formed with a third limiting block 115. The first retention body 210 is mounted on the rear side 112 of the insulated body 110, and has a first limiting recess 212 to receive the third limiting block 115 therein once the first retention body 210 is attached to said rear side 112 of the insulated body 110, thereby preventing relative movement between the first retention body 210 and the insulated body 110 along the direction D1.

The second retention member 300 preferably includes a second retention body 310 inserted via the coupling slot 1116 for coupling to the insulated body 110 and a plurality of second terminals 320 embedded partially in the second retention body 310 via the insert-molding process so as to extend along D1. After assembly, the second terminals 320 are partially exposed from the terminal holes 117 in the top side of the insulated body 110.

Note that it is quite simple to install the terminals 220, 320 on the insulated base 100.

The electrical connector assembly of the present invention further includes an enclosing member 400 having an enclosing body 410 that covers the insulated body 110 from above, a pair of clamp holding elements 420 and a pair of fifth limiting blocks 412 at two ends of the enclosing body 410. The enclosing body 410 defines at the bottom portion a plurality of terminal channels 411 and a module restricting block 413. The clamp holding elements 420 further define a pair of second clamp holes 421 aligned respectively with the clamp holes 131.

The enclosing body 410 cooperates with the insulated body 110 to define an insert chamber 2001 therebetween for receiving the memory module 4000 therein such that after assembly the first terminals 220 respectively extend into the terminal channels 411 in the enclosing body 410 while partial sections of the second terminals 320 exposed from the terminal holes 117 of the insulated body 110 are retained within the insert chamber 2001 (see FIG. 7). In addition, the fifth limiting blocks 412 being located at a level above the guide slots 132 prevents upward removal of the first retention member 200 from the insulated body 110.

Note that the module restricting block 413 is located within the insert chamber 2001 and is used for guiding smooth insertion of the memory module 4000 into the insert chamber 2001.

The clamping members 3000 extend outward through the insulated body 110 and the enclosing body 410. Each clamping member 3000 preferably includes a clamping arm 500 made from metal and having one end inserted into the clamp holes 131, 420, and an edge clip 600 provided at the other end of the clamping arm 500 and having a clip recess 610 for receiving the edge of the memory module 4000, thereby retaining the memory module 4000 securely in the insert chamber 2001.

Figure 8:
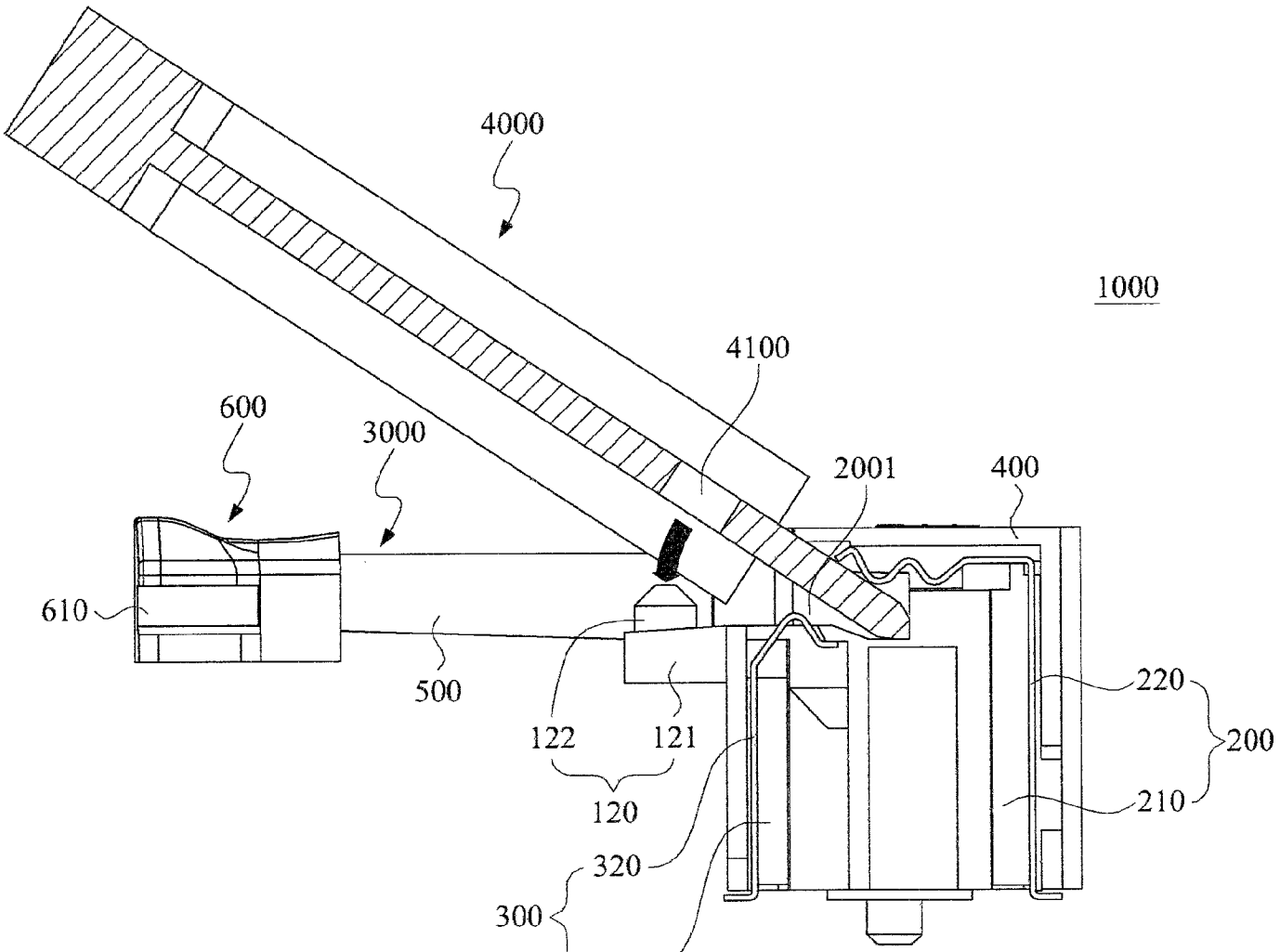
FIGS. 8 and 8A respectively illustrate fragmentary sectional and insertion of a memory card into the electrical connector assembly of the present invention.
Figure 8A:
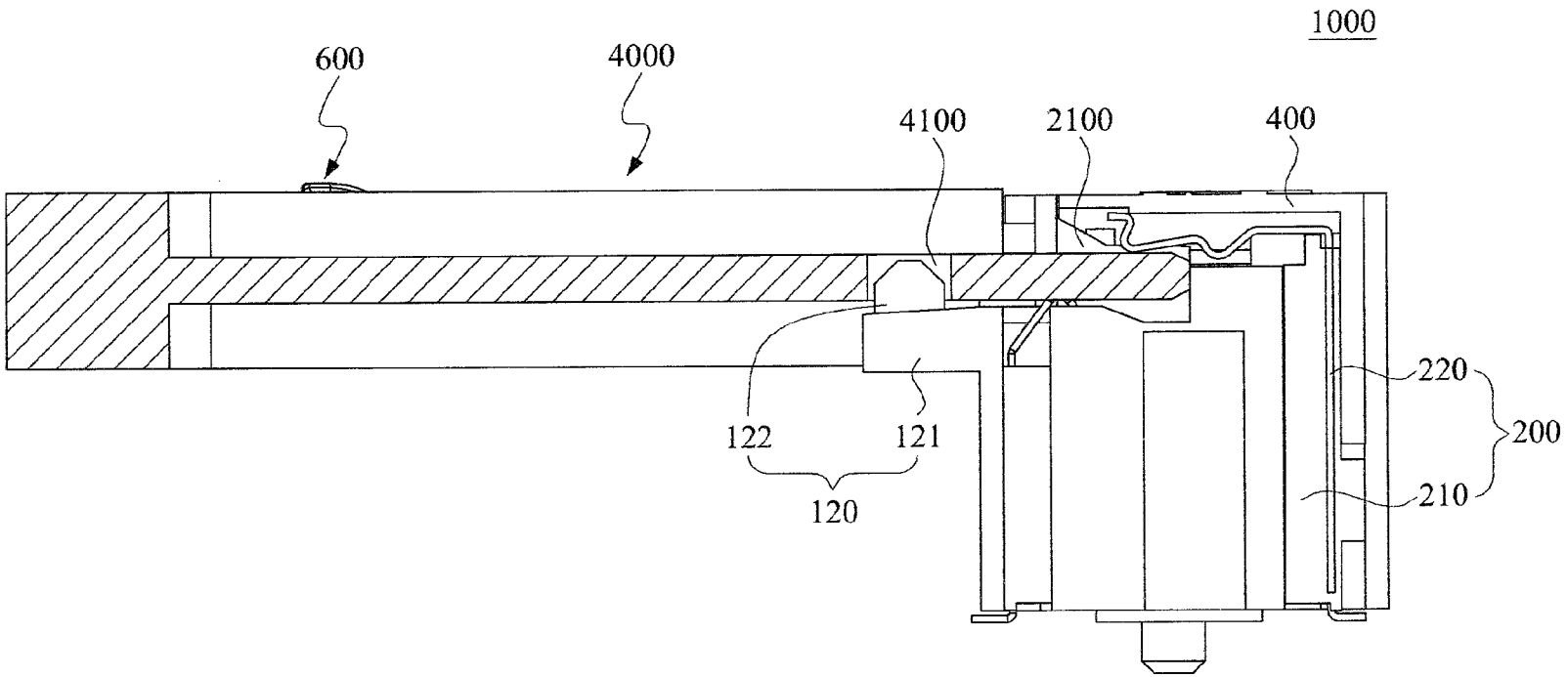

FIGS. 8 and 8A respectively illustrate fragmentary sectional and insertion of a memory card into the electrical connector assembly of the present invention. When it is desired to insert the memory module 4000 into the insert chamber 2001 in the electrical connector assembly of the present invention, the memory module 4000 is held inclinedly with respect to the insert chamber 2001, and is inserted thereinto. After partially inserting the memory module 4000 within the chamber 2001, the module 4000 is pressed downward so as to engage the lower edge of the module 4000 within the clip recess 610 of the edge clip 600 such that the engaging protrusions 122 respectively extend through and engage the card holes 4100 in the memory module 4000, as best shown in FIG. 8A. Under this condition, the bottom side of the memory module 4000 is seated securely and firmly on the planar support faces of the supporting elements 120, thereby preventing downward leaning of the memory module 4000.

It is noted that the electrical connector assembly 1000 of the present invention is provided with fool-proofing function due to presence of the engaging protrusions 122 which extend through the card holes 4100 in the memory module 4000 (see FIG. 8), and which enable smooth engagement of the lateral edge of the module 4000 with the clip recesses 610 of the clamping members during downward pressing of the module 4000. In addition, the protrusions 122 prevent lateral movement of the memory module 4000 once inserted within the insert chamber 2001.

Figure 9:
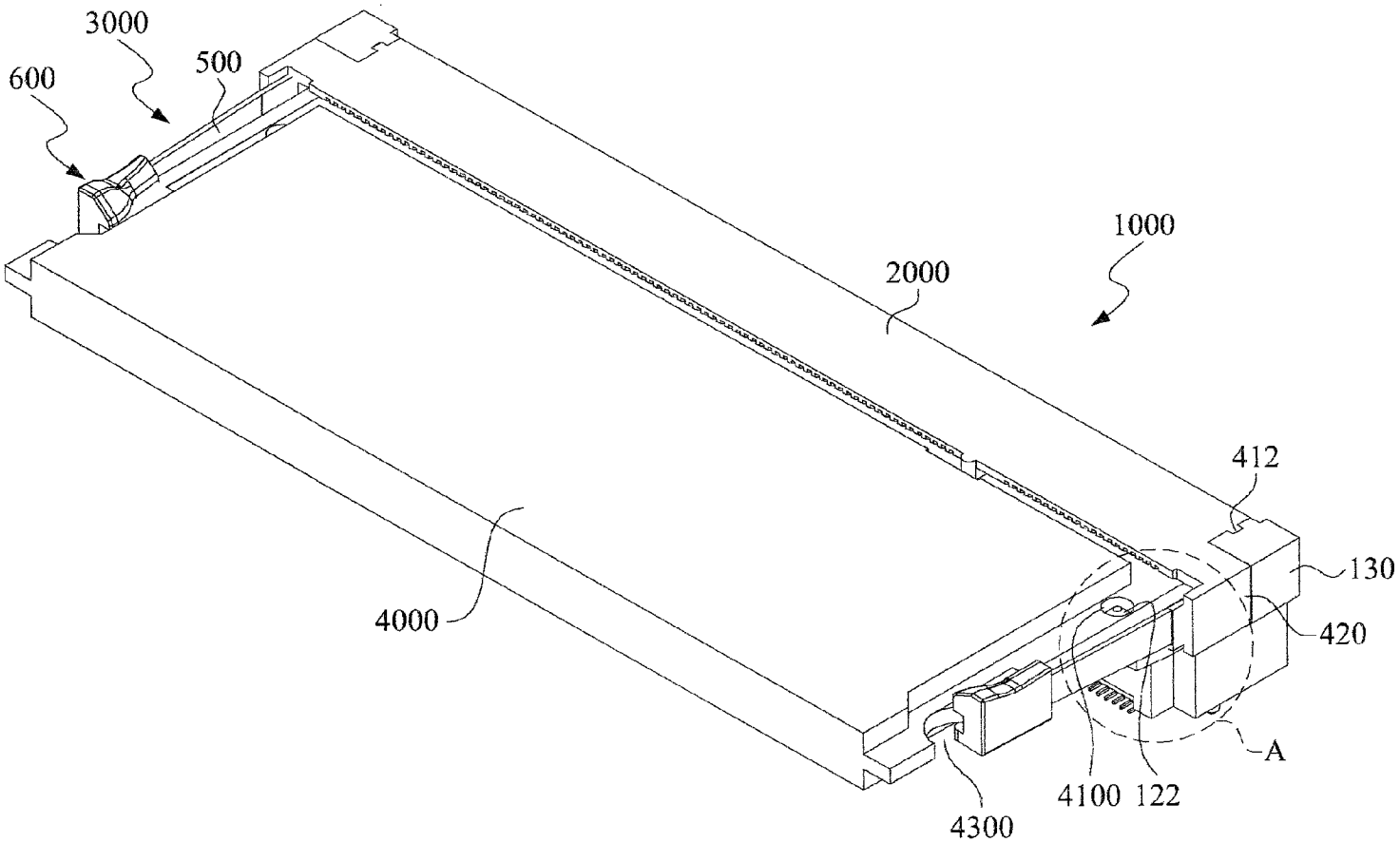
FIG. 9 shows the electrical connector assembly of the present invention in application.
Figure 9A:
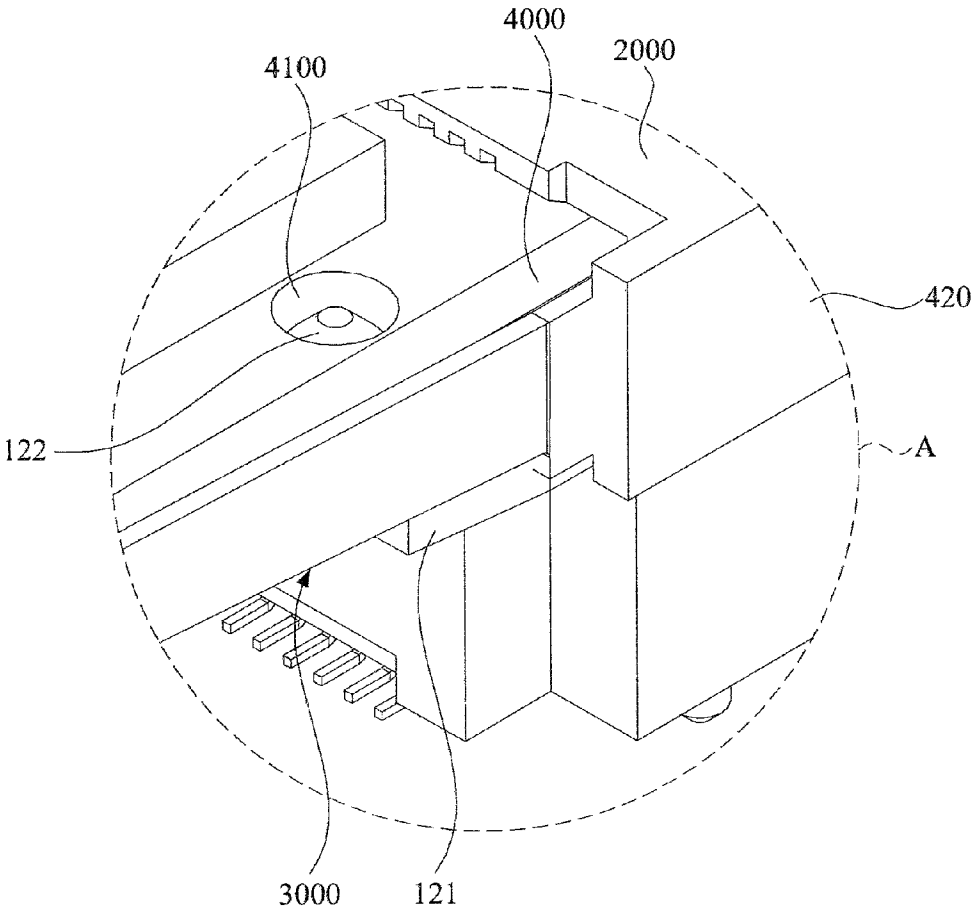
FIG. 9A is an enlarged view of a portion of FIG. 8A.

FIG. 9 shows the electrical connector assembly 1000 of the present invention in application while FIG. 9A is an enlarged view of a portion of FIG. 8A. When the memory module 4000 is inserted into the electrical connector assembly 1000 of the present invention, the edge clips 600 cooperatively clamp the lateral edge of the module 4000 with the protrusions 122 extending through the card holes 4100 in the memory module 4000. At this time, the bottom side of the memory module 4000 is seated securely and firmly on the planar support faces 12 of the supporting elements 120. Note the clamping members 3000 employed in the present invention respectively have simple structure when compared to the prior art ones.

As described above, the electrical connector assembly of the present invention includes the clamping members 3000 and the supporting elements 120 of simple structures via which the memory module can be stably retained within the insert chamber. Unlike to the prior art, no edge engaging elements for engaging the edges of memory module and the support seats for supporting the module from below are employed in the present electrical connector assembly. In other words, the production cost is consequently reduced in addition to providing an additional room on the printed circuit board. Due to presence of the protrusions 122 for preventing lateral movement of the module 4000, the present connector assembly has fool-proofing function. Moreover, since the first and second terminals can be partially embedded within the retention bodies in advance via the insert-molding process, the assembly time thereof is shortened. The set of the first and second terminals are not required to be inserted one set after the other as in the prior art. Thus, the quality of the electrical connector assembly of the present invention is improved.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector assembly, comprising:

an insulated base including an insulated body having a front surface;

two fixing members projecting from two opposite ends of said insulated body;

two supporting elements formed on said front surface of said insulated body and projecting transversely outward therefrom, each of said supporting elements having a planar support face and an engaging protrusion projecting perpendicularly from said support face; and two clamping members mounted respectively on said opposite ends of said insulated body, each of said clamping members having a first end coupled to one of the supporting elements and extending transversely to a second end, each said clamping member including an edge clip transversely displaced from said supporting element;

wherein, once a memory card provided with holes is inserted into the electrical connector assembly, said clamping members cooperatively clamp two opposite ends of the memory card therebetween while said engaging protrusions matingly engage said holes.

2. The electrical connector assembly according to claim 1, further comprising a first retention member including first retention body for coupling to said insulated body and a plurality of first terminals mounted on said first retention body.

3. The electrical connector assembly according to claim 2, wherein said insulated body further has a rear side opposite said front surface, said first retention body being attached to said rear side of said insulated body.

4. The electrical connector assembly according to claim 1, further comprising a second retention member including a second retention body for coupling to said insulated body and a plurality of second terminals mounted on said second retention body.

5. The electrical connector assembly according to claim 4, wherein said insulated body further has a bottom side formed with a coupling slot via which said second retention member is inserted for coupling second retention body to said insulated body.

6. The electrical connector assembly according to claim 5, wherein said insulated body further has a top side, which is opposite to said bottom side, which is formed with a plurality of terminal holes in spatially communication with said coupling slot and via which said second terminals are exposed therefrom.

7. The electrical connector assembly according to claim 1, further comprising an enclosing body for covering said insulated body with said clamping members extending through insulated body and said enclosing body.

8. The electrical connector assembly according to claim 1, further comprising an enclosing body that covers said insulated body and that cooperates with said insulated body to define an insert chamber therebetween.

9. The electrical connector assembly according to claim 8, further comprising a first retention member including first retention body for coupling to said insulated body and a plurality of first terminals mounted on said first retention body.

10. The electrical connector assembly according to claim 9, wherein said insulated body further has a rear side opposite said front surface, said fixing members cooperatively defining a pair of guide slots for holding said first retention body, thereby mounting said first retention body on said rear side of said insulated body.

11. The electrical connector assembly according to claim 10, wherein said fixing members further cooperatively define a first limiting block within said pair of guide slots, said insulated body further having a second limiting block engaging with said first limiting block to prevent relative movement between said first retention body and said insulated body once said first retention body is mounted on said rear side of said insulated body.

12. The electrical connector assembly according to claim 11, wherein said insulated body further has a rear side that is opposite said front surface and that is formed with a third limiting block, said first retention body being mounted on said rear side of said insulated body and having a first limiting recess to receive said third limiting block therein once said first retention body is attached to said rear side of said insulated body.

* * * * *